US005357324A

United States Patent [19]

Montfort

[11] Patent Number: 5,357,324

[45] Date of Patent: Oct. 18, 1994

[54] APPARATUS FOR APPLYING VIBRATORY MOTION TO A FLEXIBLE PLANAR MEMBER

[75] Inventor: David B. Montfort, Penfield, N.Y.

[73] Assignee: Xerox Corporation, Stamford, Conn.

[21] Appl. No.: 158,322

[22] Filed: Nov. 29, 1993

[51] Int. Cl.[5] ..... G03G 15/14

[52] U.S. Cl. ..... 355/273; 355/271

[58] Field of Search ..... 355/271, 273, 274, 276, 355/296; 118/652; 310/325; 15/1.51; 134/1

[56] References Cited

U.S. PATENT DOCUMENTS

| | | | |
|---|---|---|---|
| 4,111,546 | 9/1978 | Maret | 355/297 |
| 4,987,456 | 1/1991 | Snelling et al. | 355/273 |
| 5,016,055 | 5/1991 | Pietrowski et al. | 355/273 |
| 5,081,500 | 1/1992 | Snelling | 355/273 |

*Primary Examiner*—William J. Royer
*Attorney, Agent, or Firm*—Denis A. Robitaille

[57] ABSTRACT

An apparatus for enhancing transfer of a developed toner image from an image bearing member to a support substrate including a resonator suitable for generating vibratory energy arranged in line contact with the back side of the image bearing member for uniformly applying vibratory energy to the image bearing member. The toner release enhancing system includes a resonator for applying vibratory energy to the image bearing member to facilitate toner release therefrom, a vacuum source, including a vacuum plenum substantially enclosing the resonator and defining an opening adjacent the image bearing member, wherein the vacuum source provides sufficient force at the vacuum plenum opening to draw the image bearing member toward the resonator, and a replaceable coupling cover for mounting on the vacuum plenum, in alignment with the opening defined thereby, to couple the resonator to the image bearing member. The replaceable resonator coupling cover of the present invention provides a simple, and inexpensive replaceable protective coupling attachment for extending the functional life of the resonator, and in particular, the horn thereof and also tends to optimize the region in which vibratory energy is delivered to the image bearing member by dampening the vibration of the belt outside of the transfer region, resulting in a focused area of vibration.

31 Claims, 4 Drawing Sheets

APPARATUS FOR APPLYING VIBRATORY MOTION TO A FLEXIBLE PLANAR MEMBER

The present invention relates generally to a system for transfer of charged toner particles between image bearing surfaces in electrostatographic printing applications, and more particularly concerns an apparatus for applying vibratory energy to an imaging surface for enhanced toner transfer in an electrostatographic printing machine.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge on the photoconductive surface in image areas, thereby creating an electrostatic latent image of the original document on the photoreceptive member. Charged developing material is subsequently deposited onto the photoreceptive member such that the toner particles are attracted to the charged image areas to develop the electrostatic latent image into a visible image. This developed image is then transferred from the photoreceptive member, either directly or after an intermediate transfer step, to a copy sheet or other support substrate to create an image on the copy sheet corresponding to the original document. The transferred image may then be permanently affixed to the copy sheet through a process called "fusing" In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction where charge is deposited on a charge retentive surface in response to electronically generated or stored images.

In a conventional electrostatographic printing machine, the process of transferring charged toner particles from an image bearing support surface, such as a photoreceptor, to a second support surface, such as a copy sheet or an intermediate transfer belt, is enabled by overcoming adhesion forces holding toner particles to the image bearing surface. Typically, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. This corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

As described, the process of transferring development materials in an electrostatographic system involves the physical detachment and transfer-over of charged toner particles from an image bearing surface into attachment with a second surface via electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required for inducing the physical detachment and transfer-over of the charged toner particles without scattering or smearing of the developer material. Unfortunately, the interface between the image bearing surface and the second support surface is not always optimal. In particular, situations arise in which a copy sheet is not perfectly planar, such as the case in which copy sheets that have already passed through a fixing operation (e.g., heat and/or pressure fusing), perforated sheets, or sheets that are cockled or wrinkled for some reason or another, resulting in non-uniform contact between the sheet and the image bearing surface, creating gaps which prevent contact with the image bearing surface. There is a tendency for toner not to transfer across these gaps, causing a copy quality defect referred to as transfer deletion.

The problems associated with transfer deletions have been addressed by various means. For example, mechanical devices that force the second support surface into intimate and complete contact with the image bearing surface have been incorporated into transfer systems. For example, U.S. Pat. No. 4,947,214 to Baxendell et al. discloses the use of a blade arrangement for sweeping over the back side of the second supporting surface at the entrance to the transfer region. Alternatively, the use of vibratory energy has been disclosed, for example in U.S. Pat. No. 3,854,974 to Sato, et al., as a method for enhancing toner release from the image bearing surface. More recently, systems which incorporate a resonator suitable for generating focused vibratory energy, arranged along the back side of the image bearing surface for applying uniform vibratory energy thereto, have been disclosed, whereby toner is released from the image bearing surface despite the fact that electrostatic charges in the transfer zone may be insufficient to attract toner from the image bearing surface to the second support surface (see U.S. Pat. No. 5,081,500 to Snelling, for example). Various arrangements for coupling a resonator to an image bearing surface such that vibratory motion can be applied thereto have been proposed in U.S. Pat. No. 4,987,456 to Snelling, et al., the contents of which are completely incorporated by reference herein.

As disclosed in U.S. Pat. No. 4,987,456, a resonator suitable for generating focused vibratory energy generally includes a contacting tip which is brought into tension or penetration contact with the image bearing belt for coupling the vibratory motion located by the resonator to the belt. Thus, proper coupling is necessary between the photoreceptor belt and the resonator tip for transmitting identical sinusoidal motion from the tip to the toner residing on the belt. However, a number of problems develop as a result of the direct contact between the belt and the resonator tip. For example, abrasive action caused by continuous motion of the belt against the resonator tip causes excessive wear and deterioration of the tip which, in turn, changes the resonant frequency of the resonator such that the resonator requires a tracking power supply, or a widened band width, to accommodate for this frequency shift. In addition, the seam of the belt passes against the resonator tip, a significant torque spike is generated, causing abrupt vibration along the belt surface.

The present invention is directed toward a vacuum plenum design incorporating a replaceable resonator coupling cover for coupling vibratory energy from a resonator tip to a belt.

The following disclosures may be relevant to various aspects of the present invention:

U.S. Pat. No. 4,111,546 Patentee: Maret Issued: Sep. 5, 1978

U.S. Pat. No. 4,987,456 Patentee: Snelling, et al. Issued: Jan. 22, 1981

U.S. Pat. No. 5,016,055 Patentee: Pietrowski, et al. Issued: May 14, 1991

U.S. Pat. No. 5,081,500 Patentee: Snelling Issued: Jan. 14, 1992

The relevant portions of the foregoing disclosures may be briefly summarized as follows:

U.S. Pat. No. 4,111,546 discloses enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (piezoelectric element) at a frequency in the range of about 20 kilohertz.

U.S. Pat. No. 4,987,456 discloses a resonator suitable for generating vibratory energy arranged in live contact with the back side of a charge retentive imaging member for uniformly applying vibratory energy thereto. The resonator includes a vacuum producing element, a vibratory member, and a seal arrangement, whereby a vacuum is applied at the point of contact with the charge retentive surface to draw the surface into intimate contact engagement with the vibratory member.

U.S. Pat. Nos. 5,016,055 to Pietrowski et al. and 5,081,500 disclose a method and apparatus for using vibratory energy in combination with the application of a transfer field for enhanced transfer in electrophotographic imaging. An electrophotographic device, including a flexible belt-type transfer member or a sheet of paper is brought into intimate contact with a charge retentive member bearing a developed latent image at a transfer station for electrostatic transfer of toner from the charge retentive surface to the sheet. At the transfer station, a resonator suitable for generating vibratory energy is arranged in line contact with the back side of the charge retentive surface for uniformly applying vibratory energy to the charge retentive member such that toner will be released from the forces adhering it to the charge retentive surface at the line contact position by means of electrostatic and mechanical forces. In those areas characterized by non-intimate contact of the sheet with the charge retentive surface, toner is transferred across the gap by the combination of vibratory energy and the electrostatic transfer process, despite the fact that the charge on the paper would not normally be sufficient to attract toner to the sheet from the charge retentive surface.

In accordance with one aspect of the present invention, there is provided a system for enhancing transfer of toner from an image bearing member, comprising: means for applying vibratory energy to the image bearing member to facilitate toner release therefrom; vacuum means for providing sufficient force to draw the image bearing member toward the vibratory energy means; and a cover for being mounted between the vibratory energy means and the image bearing member to couple the vibratory energy means to the image bearing member.

In accordance with another aspect of the present invention, an electrostatographic printing machine of the type in which a developed toner image is transferred from an image bearing member to a support substrate via a transfer system is provided, including a system for enhancing release of toner from the image bearing member. The toner release enhancing system includes a resonator for applying vibratory energy to the image bearing member to facilitate toner release therefrom, a vacuum source, including a vacuum plenum substantially enclosing the resonator and defining an opening adjacent the image bearing member, wherein the vacuum source provides sufficient force at the vacuum plenum opening to draw the image bearing member toward the resonator, and a coupling cover for mounting on the vacuum plenum, in alignment with the opening defined thereby, to couple the resonator to the image bearing member.

In accordance with yet another aspect of the present invention, an apparatus for applying vibratory motion to a flexible planar member is provided, comprising: resonator means for applying vibratory energy to the flexible planar member; vacuum means, including a vacuum plenum substantially enclosing the resonator means and defining an opening adjacent the flexible planar member, wherein the vacuum means provides sufficient force at the vacuum plenum opening to draw the flexible planar member toward the resonator means; and cover means for mounting on the vacuum plenum, in alignment with the opening defined thereby, to couple the resonator means to the flexible planar member.

These and other aspects of the present invention will become apparent from the following description in conjunction with the accompanying drawings, in which.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the following description progresses, with specific reference to the drawings.

Figure 4:
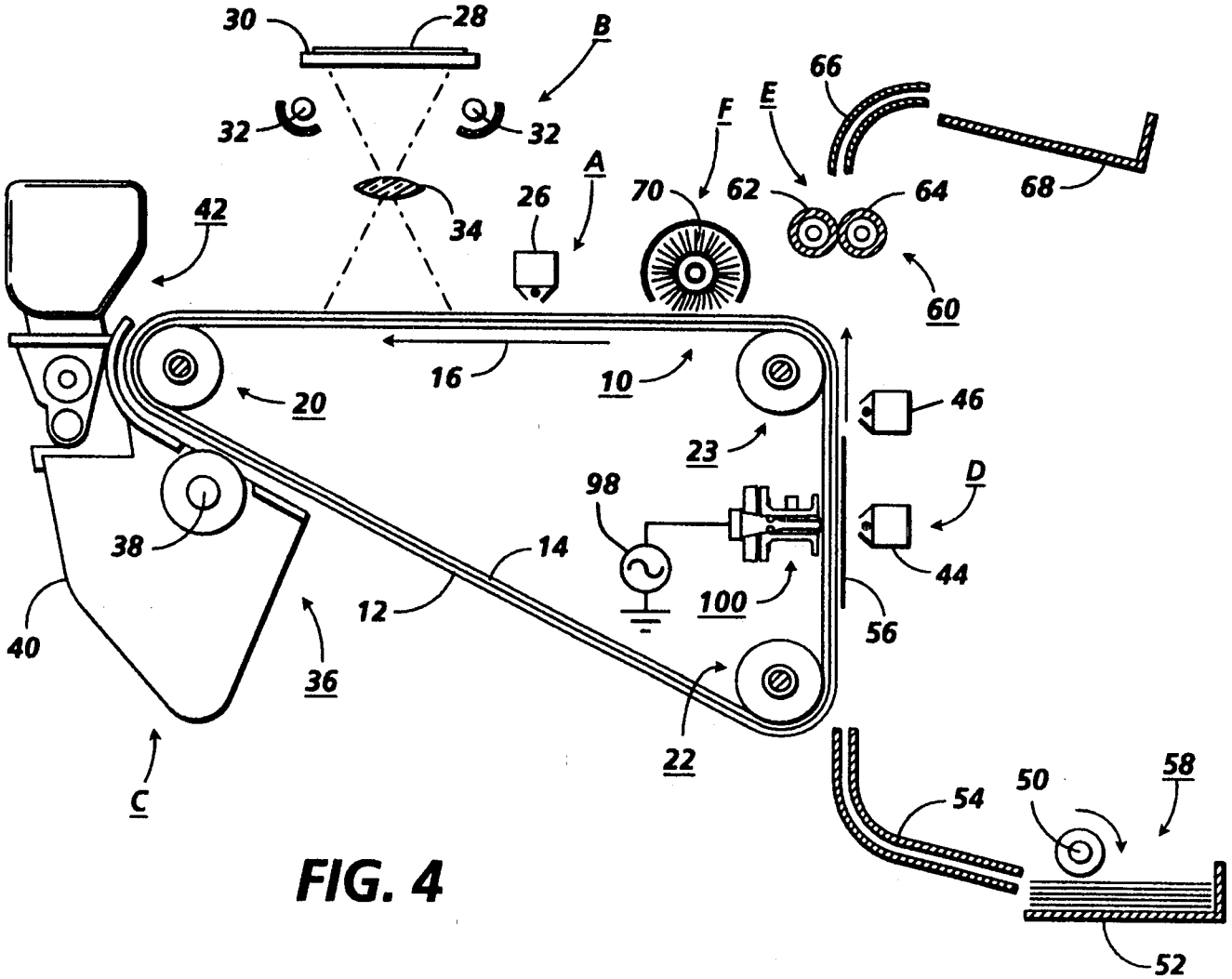
FIG. 4 is a schematic side view of an illustrative electrophotographic reproducing machine including an illustrative embodiment of a transfer station including the vacuum plenum and coupling cover arrangement shown in FIG. 1.

For a general understanding of an exemplary printing machine incorporating the features of the present invention, a schematic depiction of the various processing stations, and the machine components thereof, is provided in FIG. 4. Although the vacuum plenum and coupling cover arrangement of the present invention is particularly well adapted for use with a transfer subsystem in an automatic electrophotographic reproducing machine as shown in FIG. 4, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example. It will be further appreciated that the present invention is not necessarily limited to the particular embodiment or embodiments shown and described herein.

Moving now to a description of FIG. 4, prior to discussing the specific features of the present invention in detail, the exemplary electrophotographic reproducing apparatus employs a belt 10 including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in the direction of arrow 16 about a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a single developer roll 38 disposed in developer housing 40. In the developer housing 40, toner particles are mixed with carrier beads, generating an electrostatic charge therebetween which causes the toner particles to cling to the carrier beads to form developing material. The magnetic developer roll 38 is rotated in the developer housing 40 to attract the developing material therein, forming a "brush" comprising carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface for advancing the developed image to transfer station D. At transfer station D, a sheet of support material 56, such as paper or some other copy sheet, is moved into contact with the developed toner image via sheet feeding apparatus 58 and chute 54 for placing the sheet 56 into synchronous contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a timed sequence for transfer thereto at transfer station D.

In the illustrated embodiment, a corona generating device 44 charges the support material 56 to the proper potential so that the toner image is attracted from the surface of photoreceptor belt 10 to the sheet 56 while the copy sheet 56 is also electrostatically tacked to photoreceptor belt 10. The preferred embodiment of the present invention also includes a relatively high frequency acoustic or ultrasonic resonator 100, driven by an AC source 98, arranged in vibratory relationship with the back side of belt 10 at a position corresponding to the location of transfer corona generator 44. The resonator 100 applies vibratory energy to the belt 10 for agitating the toner developed in imagewise configuration thereon to provide mechanical release of the toner particles from the surface of the belt 10. Such vibratory energy enhances toner transfer by releasing the attractive forces between the toner particles and the belt 10. Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems are described in U.S. Pat. Nos. 4,987,456, 50016,055 and 5,081,500 of common assignee, which are incorporated in their entirety by reference into the present application for patent. Further details of acoustically assisted xerographic toner transfer can also be found in The Society for Imaging Science and Technology (IS&T) Final Program and Proceedings, 8th International Congress on Advances in Non-impact Printing Technologies, Oct. 25–30, 1992 in an article entitled "Acoustically Assisted Xerographic Toner Transfer", by Crowley, et al. The contents of this paper are incorporated by reference herein.

After transfer, a corona generator 46 charges the copy sheet 56 with an opposite polarity to release the copy sheet from belt 10, whereupon the sheet 56 is stripped from belt 10. The support material 56 is subsequently separated from the belt 10 and transported to a fusing station E. It will be understood by those of skill in the art, that the support substrate may also be an intermediate surface or member, which carries the toner image to a subsequent transfer station for transfer to a final support surface. These types of surfaces are also charge retentive in nature. Further, while belt type members are described herein, it will be recognized that other substantially non-rigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support substrate 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The foregoing description should be sufficient for the purposes of the present application for patent to illustrate the general operation of an electrophotographic reproducing apparatus incorporating the features of the present invention. As described, the electrophotographic reproducing apparatus may take the form of any of several well known devices or systems. Variations of specific electrostatographic processing subsystems or processes may be expected without affecting the operation of the present invention.

With particular reference to the principle of enhanced toner release as provided by the vibratory energy assisted transfer system described hereinabove, a relatively high frequency acoustic or ultrasonic resonator 100, which may include a piezoelectric device, driven by an A.C. source 98, is generally operated at a frequency between 20 kHz and 200 kHz and typically at approximately 60 kHz. The resonator 100 is arranged in vibrating relationship with the back side of belt 10, at a position closely in line with transfer station D. Vibration of belt 10 agitates toner developed in imagewise configuration on belt 10 for inducing mechanical release of the toner from the surface of belt 10, allowing more efficient electrostatic attraction of the toner to a sheet during the transfer step. In a preferred arrangement, the resonator 100 is configured such that the vibrating surface thereof is parallel to belt 10 and transverse to the direction of belt movement 16, with a length approximately co-extensive with the belt width. The belt 10, described herein, has the characteristic of being non-rigid, or somewhat flexible, to the extent that it can be effected by the vibrating motion of the resonator 100.

Figure 1:
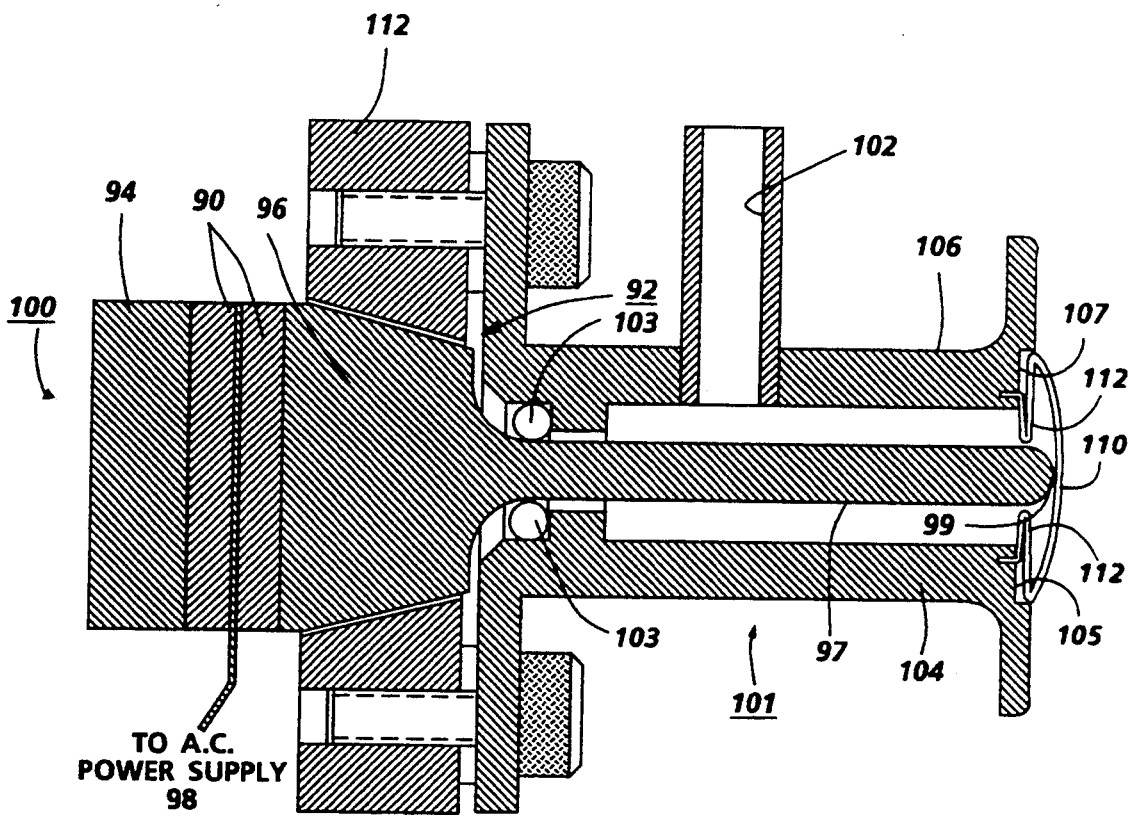
FIG. 1 is a cross sectional view of a vacuum plenum arrangement incorporating a replaceable resonator coupling cover in accordance with the present invention.

In accordance with the present invention, the resonator 100 is configured in association with a vacuum plenum 101 arrangement, including a vacuum supply 102 (vacuum source not shown) and a replaceable resonator coupling cover 110, as shown in FIG. 1. This arrangement provides positive contact engagement between the resonator 100 and the photoreceptor 10 which may or may not penetrate the normal plane of the photoreceptor 10 for transmitting vibratory energy from the resonator 100 to photoreceptor 10. The replaceable resonator coupling cover 110 advantageously protects the resonator from wear and minimizes the photoreceptor torque spike occurring from contact with the seam of the photoreceptor 10 while enhancing toner release provided by the vibratory energy assisted transfer system by creating a damping effect for eliminating image quality defects caused by perturbation of vibrational energy outside the region of transfer. The particular features of the replaceable resonator coupling cover 110 and the additional benefits provided thereby will discussed in greater detail hereinbelow.

Figure 3:
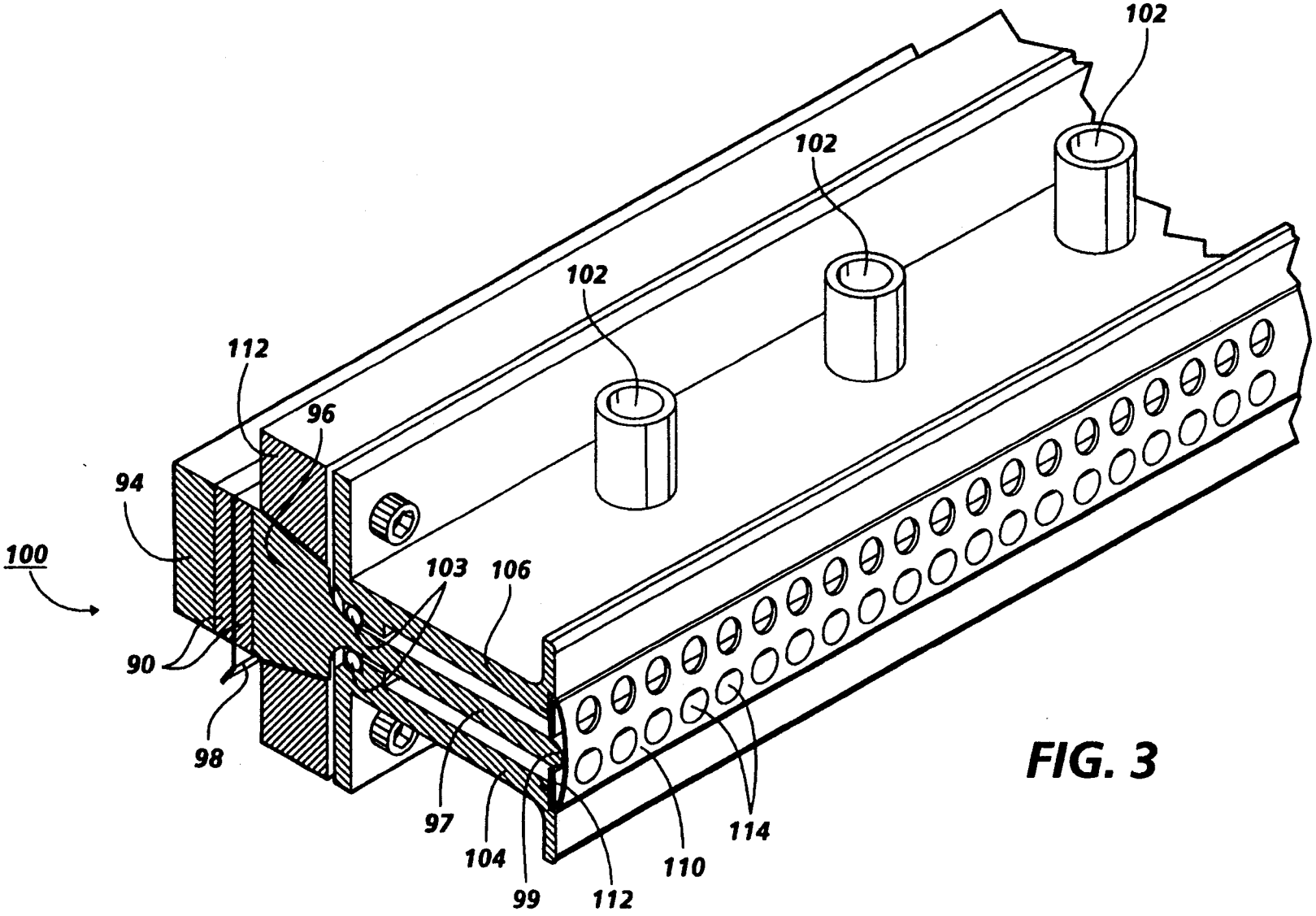
FIG. 3 is a perspective view of the vacuum plenum arrangement and coupling cover shown in FIG. 1.

FIGS. 1 and 3 provide detailed side and perspective illustrations of a particular embodiment for a resonator assembly arranged for being vacuum coupled in contact with the backside of a photoreceptor 10 in the machine configuration shown in FIG. 4. With reference to FIG. 1, resonator 100 may comprise a piezoelectric transducer element 90 coupled to a directional horn 92, supported together on a backplate 94. Horn 92 includes a base platform 96, and a horn body 97 having a radial tip 99 for radiating vibratory energy from the resonator 100. Various shapes and structures have been considered for horn 92, as discussed in U.S. Pat. No. 4,987,456. An adhesive epoxy and conductive mesh layer may be used to bond the assembly elements together without the requirement of a backplate or other mechanical coupling devices. Removing the backplate reduces the tolerances required in construction of the resonator, particularly allowing greater tolerance in the thickness of the piezoelectric element.

Directional horn 92 is enclosed by a generally air tight vacuum plenum 101 defined by upstream and downstream walls 104 and 106, respectively. The vacuum plenum 101 is sealed at either end along the marginal edges of the belt 10 at inboard and outboard sides thereof (not shown), with mounting blocks connected to walls 104, 106. The interface between horn body 97 and the vacuum plenum 101 is sealed with an elastomer sealing member 103, which also serves to isolate the vibration of the horn body 97 from walls 104 and 106. Walls 104 and 106 are approximately parallel to the horn body 97, extending to a common plane and forming together an opening in the vacuum plenum 101 adjacent to the photoreceptor belt 10. The replaceable resonator coupling cover 110 of the present invention is mounted in this opening, forming an interface between the radial tip 99 of horn body 97 and the belt 10. The tip 99 of horn body 97 may either be colinear with a slightly extend just beyond the plane formed by walls 104, 106 such that the replaceable resonator coupling cover 110 is substantially planar bowed slightly, creating a colinear or concave profile at the interface with belt 10, as will be further discussed.

Vacuum plenum 101 is coupled to a vacuum or negative air pressure source such as a diaphragm pump or a blower (not shown) via outlet 102 formed in one or more locations along the length of upstream or downstream walls 104 and 106, respectively. When negative air pressure is applied to the vacuum plenum 101, via outlet 102, belt 10 is drawn into contact with the replaceable resonator coupling cover 110 so that horn body 97 imparts the vibratory energy of the resonator 100 to belt 10 via the replaceable resonator coupling cover 110. This arrangement provides positive contact engagement between the resonator 100 and the photoreceptor 10 while maintaining continuity along the region of contact between the resonator 100 and the belt 10, without regard for whether the the tip 99 of the resonator horn 97 is flat, curved and/or segmented. The coupling cover of the present invention also provides a replaceable protective coupling attachment for extending the functional life of the resonator 100, and in particular, the horn thereof, as well as the life of the photoreceptor 10.

The replaceable resonator coupling cover 110 of the present invention may be embodied in many various forms and configurations and may be provided via numerous materials. In one embodiment, as shown in FIGS. 1 and 3, which has been shown to be particularly functional, the coupling cover is fabricated from flexible, wear resistant material, for example, a strip of bronze metal, approximately 0.004 inches in thickness. This metal strip is provided with folded wing segments 112, formed by way of typical metal bending techniques, for creating resilient mounting elements along the marginal edges of the coupling cover for being inserted into receiving tracks 105 and 107 formed in the walls 104 and 106 of the air plenum 101. Mounting clips (not shown) may also be provided for supporting the marginal edges of the coupling cover in the receiving tracks 105, 107. In a preferred embodiment, it has been shown that it may be advantageous to have the coupling cover protrude slightly above the plane formed by the air plenum walls 104, 106 such that the surface profile of the air plenum/coupling cover arrangement is concave, protruding slightly toward the region of contact with the photoreceptor belt 10, while being maintained in contact with the tip 99 of resonator horn 92. It has been found that this concave surface profile provides a geometry which reduces friction in the contact region between the belt 10 and the resonator 100 by eliminating "belt wrap-over" from occurring between the dynamic belt and the resonator horn 92 and the inside edges of wails 104 and 106 which has been known to occur in configurations which do not include the coupling cover of the present invention. In addition, this geometry has been shown to advantageously reduce surface disturbance in the belt seam contact region and thereby minimizes the motion torque spike caused by contact with the belt seam customarily associated with vibratory energy assisted transfer systems. It will be understood, however, that the tip 99 of horn 92 may be substantially coplanar with the opening formed by walls 104, 106 such that the coupling cover and the overall surface profile of the resonator/vacuum plenum arrangement is substantially flat. Alternatively, the surface profile may even be convex, forming a valley adjacent the horn tip 99, as desired.

The coupling cover 110 is also provided with a series of vacuum ports 114 in the form of a plurality of apertures formed along the length of the metal strip for being situated on either side of the radial tip 99 of directional horn 92 when mounted adjacent thereto. The vacuum ports 114 operate to allow air flow through the coupling cover 110 for creating the advantageous coupling engagement between the resonator 100 and the photoreceptor 10. It should be understood that the apertures defining the vacuum ports 114 may be formed so as to reduce belt wear; for example, as a series of ecliptically or triangularly shaped apertures. It will be understood that the resonator coupling cover of this embodiment may be fabricated from various materials, not limited to metals, and that such materials may also be advantageously coated with a various coating materials, as for example, an electrodeposited layer of metallic chromium, which may provide a reduced surface energy for reducing friction forces between the cover 110 and the belt 10.

Figure 2:
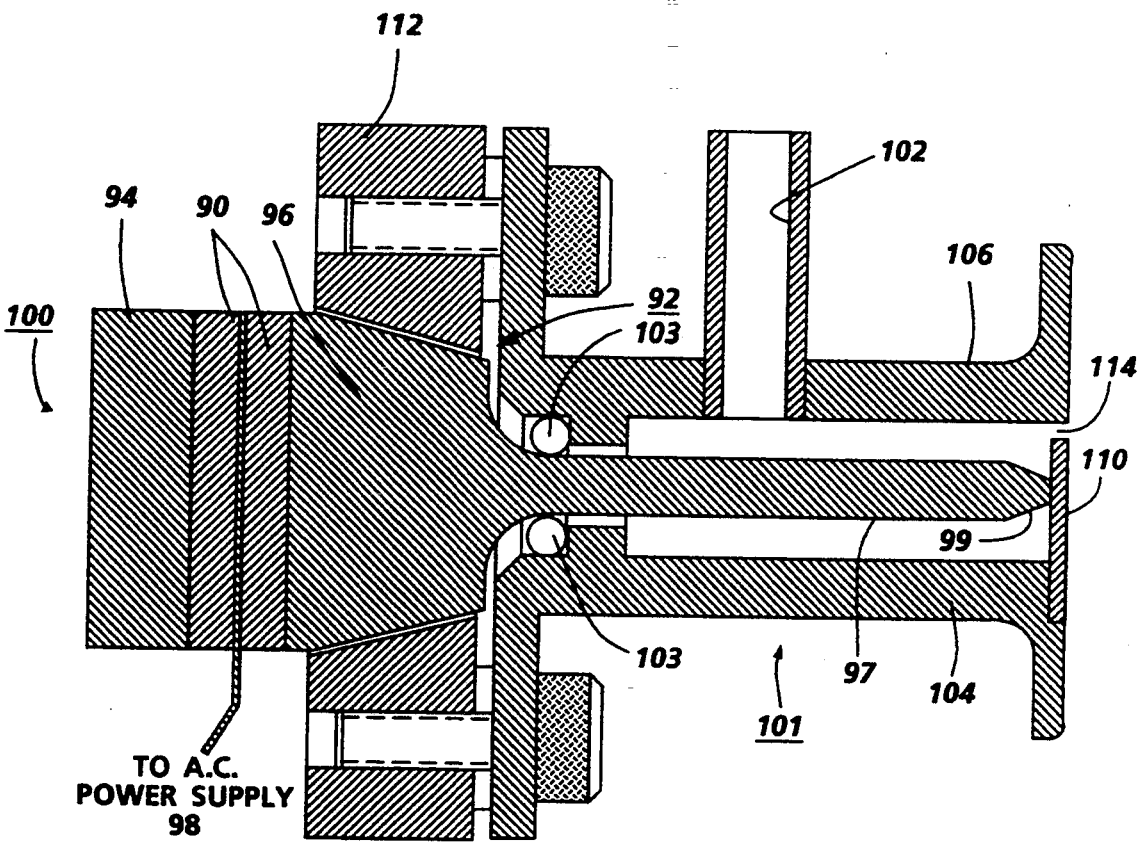
FIG. 2 is a cross sectional view of an alternative embodiment for a vacuum plenum arrangement incorporating a replaceable resonator coupling cover in accordance with the present invention.

An alternative embodiment that has also been shown to be functional is shown in FIG. 2, by way of example, wherein a thin strip of Mylar or other flexible elastomeric material, approximately 0.005 inches in thickness, is mounted, via adhesive or other means, in a single channel formed in the upstream wall 104 of the air plenum 101. The width of this Mylar strip is less than the dimension separating walls 104 and 106 at the opening formed thereby such that an air gap is formed between the coupling cover 110 and the downstream wall 106, providing a vacuum port for allowing air to flow therethrough. Obviously, this embodiment eliminates the necessity of forming a plurality of apertures in the coupling cover 110, while allowing vacuum to be pulled along the gap between the coupling cover 110 and the wall of the air plenum 101. This alternative embodiment shows an example of a configuration in which the surface profile of the resonator/vacuum plenum arrangement is substantially flat, as previously discussed.

Using the vacuum coupled resonator arrangement described above, application of high frequency acoustic or ultrasonic energy to belt 10 is induced within the area of application of the transfer field, and preferably within the area adjacent transfer corotron 44. While transfer efficiency improvements appear to be obtained with the application of high frequency acoustic or ultrasonic energy throughout the transfer field, it appears that it is desirable for the resonator 100 to deliver vibratory energy in a limited region approximately opposite the centerline of the transfer corotron 44. Thus, it is preferable to restrict the application of vibratory energy to a defined region so that vibration does not occur outside the transfer field. Notably, it has been found that application of vibratory energy outside the transfer field tends to cause greater electromechanical adherence of toner to the belt surface, creating a problem for subsequent transfer or cleaning. It is noted that the replaceable resonator coupling cover 110 of the present invention also tends to dampen the vibration of the belt 10 outside of the transfer region in which vibration is desired, resulting in a focused area of agitation whereby the vibratory energy imparted to the belt 10 does not disturb the dynamics of the sheet tacking or detacking process, or disturb the image prior to the optimal transfer region or induce back transfer at a post transfer region.

In recapitulation, the electrophotographic printing machine of the present invention includes a vibratory energy producing resonator and a replaceable resonator coupling cover for generating vibratory energy to reduce adhesion of the toner image to the image bearing member. The replaceable resonator coupling cover of the present invention provides a simple, and inexpensive replaceable protective coupling attachment for extending the functional life of the resonator, and in particular, the horn thereof and also tends to optimize the region in which vibratory energy is delivered to the image bearing member by dampening the vibration of the belt outside of the transfer region, resulting in a focused area of vibration.

It is, therefore, evident that there has been provided, in accordance with the present invention, an electrophotographic printing apparatus and, in particular, a vacuum coupling arrangement for applying vibratory energy to a photoreceptive belt, that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, the present application for patent is intended to embrace all such alternatives, modifications, and variations as are within the broad scope and spirit of the appended claims.

I claim:

1. A system for enhancing transfer of toner from an image bearing member, comprising:

means for applying vibratory energy to the image bearing member to facilitate toner release therefrom;

a cover interposed between said applying means and the image bearing member; and vacuum means for drawing the image bearing member toward said cover.

2. The system of claim 1, wherein said vacuum means includes a vacuum plenum defining a vacuum plenum opening adjacent the image bearing member, wherein said vacuum means provides sufficient force at the vacuum plenum opening to draw the image bearing member toward said cover.

3. The system of claim 2, wherein said cover includes means for mounting said cover on said vacuum plenum, in alignment with the opening defined thereby, to couple said vibratory energy means to said image bearing member.

4. The system of claim 3, wherein said cover includes an elongated body and said mounting means includes resilient wing segments extending along a length of the elongated body for mounting said cover on said vacuum plenum.

5. The system of claim 2, wherein said cover defines an aperture for permitting airflow into the vacuum plenum through the opening defined thereby.

6. The system of claim 2, wherein said vibratory energy means includes a horn for directing vibratory energy to the image bearing member.

7. The system of claim 6, wherein said vacuum plenum includes a pair of wall members having said horn interposed therebetween, said wall members extending to a substantially common plane for defining the vacuum plenum opening.

8. The system of claim 7, wherein said horn extends substantially to said plane defining the vacuum plenum opening such that said cover is provided with a substantially planar profile when mounted across the vacuum plenum opening.

9. The system of claim 7, wherein said horn extends beyond the plane defining the vacuum plenum opening such that said cover is provided with a substantially concave profile when mounted across said wall members.

10. The system of claim 7, wherein at least one of said wall members includes a vacuum port for coupling said vacuum plenum to said vacuum means.

11. The system of claim 7, wherein at least one of said wall members includes a receiving track adjacent the vacuum plenum opening for mounting said cover thereon.

12. The system of claim 1, wherein said vibratory energy means includes an acoustic resonator.

13. The system of claim 1, wherein said vibratory energy means includes a piezoelectric device.

14. The system of claim 1, further including means for electrostatically attracting a toner image from the image bearing member.

15. An electrostatographic printing machine of the type in which a developed toner image is transferred from an image bearing member to a support substrate via a transfer system, including a system for enhancing release of toner from the image bearing member, comprising:

a resonator for applying vibratory energy to the image bearing member to facilitate toner release therefrom;

a coupling cover interposed between said resonator and the image bearing member; and a vacuum source for drawing the image bearing member toward said coupling cover.

16. The electrostatographic printing machine of claim 15, wherein said vacuum source includes a vacuum plenum substantially enclosing said resonator and defining a vacuum plenum opening adjacent the image bearing member, wherein said vacuum source provides sufficient force at the vacuum plenum opening to draw the image bearing member toward said coupling.

17. The electrostatographic printing machine of claim 16, wherein said coupling cover includes a resilient element for mounting said coupling cover on said vacuum plenum, in alignment with the opening defined thereby, to couple said resonator to said image bearing member.

18. The electrostatographic printing machine of claim 17, wherein said coupling cover includes an elongated body and said resilient element includes a wing segment extending along a length of the elongated body for mounting said coupling cover to said vacuum plenum.

19. The electrostatographic printing machine of claim 16, wherein said coupling cover defines an aperture for permitting airflow into the vacuum plenum through the opening defined thereby.

20. The electrostatographic printing machine of claim 16, wherein said resonator includes a horn for directing vibratory energy to the image bearing member.

21. The electrostatographic printing machine of claim 20, wherein said vacuum plenum includes a pair of wall members having said horn interposed therebetween, said wall members extending to a substantially common plane for defining the vacuum plenum opening.

22. The electrostatographic printing machine of claim 21, wherein said horn extends substantially to said plane defining the vacuum plenum opening such that said coupling cover is provided with a substantially planar profile when mounted across the vacuum plenum opening.

23. The electrostatographic printing machine of claim 21, wherein said horn extends beyond the plane defining the vacuum plenum opening such that said coupling cover is provided with a substantially concave profile when mounted across said wall members.

24. The electrostatographic printing machine of claim 21, wherein at least one of said wall members includes a vacuum port for coupling said vacuum plenum to said vacuum source.

25. The electrostatographic printing machine of claim 21, wherein at least one of said wall members includes a receiving track adjacent the vacuum plenum opening for mounting said coupling cover thereon.

26. The electrostatographic printing machine of claim 15, wherein said resonator includes an ultrasonic resonating device.

27. The electrostatographic printing machine of claim 15, wherein said resonator includes a piezoelectric device.

28. The electrostatographic printing machine of claim 15, further including a corona generating device for electrostatically attracting the developed toner image from the image bearing member, said resonator being positioned in alignment with said corona generating device with said image bearing member being interposed therebetween.

29. An apparatus for applying vibratory motion to a flexible planar member, comprising:

resonator means for applying vibratory energy to the flexible planar member;

vacuum means, including a vacuum plenum substantially enclosing said resonator means and defining an opening adjacent the flexible planar member, wherein said vacuum means provides sufficient force at said vacuum plenum opening to draw the flexible planar member toward said resonator means; and cover means for mounting on said vacuum plenum, in alignment with the opening defined thereby, to couple said resonator means to said flexible planar member.

30. The apparatus of claim 29, wherein said cover means includes an elongated body and resilient wing segments extending along a length of the elongated body for mounting said cover means on said vacuum plenum.

31. The apparatus of claim 29, wherein said cover means defines an aperture for permitting airflow into the vacuum plenum through the opening defined thereby.

* * * * *